United States Patent [19]

Fujiyoshi

[11] Patent Number: 4,813,558

[45] Date of Patent: Mar. 21, 1989

[54] INSULATING VESSEL FOR CHILLED DRINK CONTAINER

[76] Inventor: Junko Fujiyoshi, 1-37 Matsuzono, Nishinomiya 662, Japan

[21] Appl. No.: 124,373

[22] Filed: Nov. 23, 1987

Related U.S. Application Data

[63] Continuation of Ser. No. 418,739, Sep. 16, 1982, abandoned.

[30] Foreign Application Priority Data

Sep. 19, 1981 [JP] Japan ..... 56-139251[U]

[51] Int. Cl.[4] ..... A47J 41/00

[52] U.S. Cl. ..... 215/100 R; 220/85 H; 220/903

[58] Field of Search ..... 220/85 H; 215/13 R

[56] References Cited

U.S. PATENT DOCUMENTS

| | | | |
|---|---|---|---|
| 2,081,409 | 5/1937 | Rush | 215/13 R |
| 2,670,616 | 3/1954 | Schneider | 220/85 H |
| 2,936,927 | 5/1960 | Peters | 220/85 H |
| 3,103,295 | 9/1963 | Ghee | 220/85 H |
| 3,473,682 | 10/1969 | Studen . | |
| 3,910,328 | 10/1975 | Marcoux | 215/13 R |
| 3,978,233 | 8/1976 | Bolt . | |
| 4,341,316 | 7/1982 | Bunge | 215/13 R |
| 4,344,303 | 8/1982 | Kelly, Jr. . | |

FOREIGN PATENT DOCUMENTS

| | | | |
|---|---|---|---|
| A20666 | 10/1956 | Fed. Rep. of Germany | 215/13 R |

*Primary Examiner*—Joseph Man-Fu Moy

*Attorney, Agent, or Firm*—Armstrong, Nikaido, Marmelstein & Kubovcik

[57] ABSTRACT

A heat insulating vessel is provided for holding a drink container. The vessel has a body integrally formed of a cylindrical wall portion and a bottom portion. The body is formed from a microcellularly foamed plastic wherein the upper edge of the cylindrical wall portion is at least partly inclined with respect to the bottom portion.

5 Claims, 1 Drawing Sheet

INSULATING VESSEL FOR CHILLED DRINK CONTAINER

This application is a continuation of application Ser. No. 418,739, filed Sept. 16, 1982, now abandoned.

BACKGROUND OF THE INVENTION

1. Field of the Invention

This invention relates to a new heat-insulating vessel or holder to be used to accommodate chilled drink containers, beer wine bottles or carbonated beverage cans, for example and, more particularly, this relates to a microcellular-plastic vessel having a cylindrical wall and a bottom integrally molded for maintaining the coldness of drink containers when they are served chilled.

2. Description of the Prior Art

Often when chilled drink bottles or cans are served to drinkers, the chilled effect is lost while unfinished bottles or cans are left on a table. And it is also known that, once chilled drinks become warm, they become quite tasteless. A cylindrical vessel made of microcellular plastic which is of a size for accommodating drink containers has been proposed to cover up a cylindrical part of a bottle so that the chilled status may be kept a longer time. However, the conventional insulating vessel has a flat or horizontal upper end mouth and has a diameter suited to tightly accommodate drink containers.

Certainly the tight fit of a bottle or a can into a heat insulating vessel is necessary to secure its insulating function but the rquirement for a tight fit causes the users to be inconvenienced, in particular, when they attempt to quickly fit the bottle or can into the insulating vessel. It is because the vessel can accommodate the container which is supposed to tightly fit thereinto, only when said drink container comes down at the right angle to the horizontal mouth of the vessel. Otherwise, that is, if the container is held by hand at some arbitrary angle other than the right angle to the vessel, the fitting thereinto is very difficult.

Further to the above, the conventional insulating vessels or band protectors for containers are so slippery when held by hand that sometimes drinkers drop their drink containers together with the insulating vessels.

SUMMARY OF THE INVENTION

It is a primary object of this invention to provide an insulating vessel for a chilled drink container which makes it easy and convenient to tightly fit said container into the vessel.

It is another object of this invention to provide an insulating vessel for a chilled drink container which prevents an accidental dropping due to slippage from the user's hand. Further objects and advantages will appear in the following descriptions.

This invention is directed to a microcellular plastic vessel having a cylindrical wall and a bottom, wherein the upper end of said cylindrical wall is not horizontal or parallel with respect to the bottom, but is at least partly inclined or depressive to form an inclined or oblique upper end. Therefore, said non-horizontality includes such a variation as uniform inclination, partial depression, inclined area and therebetween. However, an ellipse effect on the upper end mouth area which is the basis of enlarging the virtual mouth area will be obtained in any variation above. The explanation of said ellipse effect will be described later in this specification.

This invention is also directed to an insulating vessel with at least one finger groove on the outer wall surface of said vessel in order to prevent an accidental dropping as described before.

BRIEF DESCRIPTION OF THE DRAWINGS

Hereinafter, the invention will be described by embodiments according to the drawings of which the summary is here briefly referred to.

DETAILED DESCRIPTION OF PREFERRED EMBODIMENTS

Figure 1:
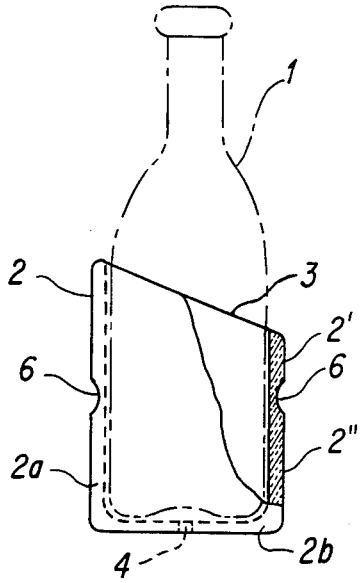
FIG. 1 shows a partly broken view of a vessel of this invention.
Figure 2:
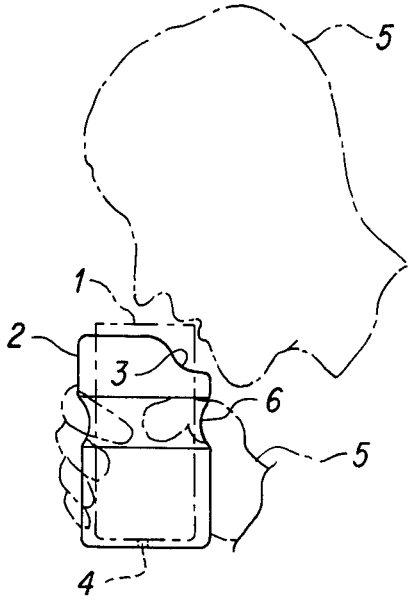
FIG. 2 shows another embodiment of a vessel of this invention.

Referring to the drawings, a bottle or a can 1 (dotted) is in a cylindrically shaped vessel 2 which is made up of a cylindrical wall **2*a* and a bottom 2*b* integrally. The vessel 2 includes microcellularly foamed core 2' at the broken part and an non-foamed skin layer 2'', which will be referred to later. An upper edge line 3 forms a rather smoothly inclined line as shown in FIG. 1 and forms an inclined curve as shown in FIG. 2. The vessel bottom 2*b* has at the center thereof a hole 4 to exhaust air at the time of accommodating the container 1. 5 (dotted line) indicates a drinker's face profile and his hand. A groove line 6** on the surface of the vessel wall is designed primarily for the thumb-finger.

Referring to the vessel 2 in the drawings, microcellularly foamed vessels of this invention can be molded by conventional plastic technologies. Available materials are foamed polyethylene, polyethyleneacetate, polypropylene, polystyrene, polyvinyl chloride, polyacetatovinyl chloride, polyurethane and the like. Of them, two part soft polyurethane is best preferred to mold vessels of this invention because the skin and core structure as shown in FIG. 1 are readily brought about in this material system by adjusting temperatures during injection molding operations.

In view of heat insulating effect, the gross gravity of the vessel is preferred to be less than 0.1, and the two part polyurethane system as described above will provide the preferred gravity. Further, the non-foamed skin surface may be used to print advertising letters or displaying figures thereon.

FIG. 1 shows the present invention used with a beer bottle wherein a smooth inclination of the upper edge 3 is recommended. FIG. 2 shows the present invention used with a beverage can wherein a drinker will directly touch his mouth on the corner of the can to which an opening exists close. Accordingly, the inclined curve line 3 as shown in FIG. 2 is recommended.

Figure 3:
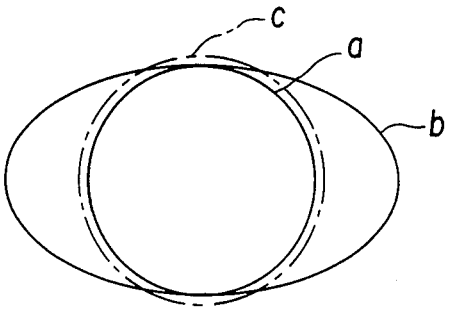
FIG. 3 shows a schematic diagram to explain the ellipse effect for support of this invention.

The ellipse effect mentioned above is explained with reference to FIG. 3. The circle a is assumed to be a sectional circle when a cylinder is cut parallel to the bottom. The ellipse b is formed when the cylinder is cut inclined or slanted with respect to the bottom. Then the circle c (dotted) having the circumferential length equal to that of the ellipse b is likewise formed when the ellipse is deformed. The circle c provides a circle larger than the circle a. The difference in size between the circle a and c is referred to as the ellipse effect in this specification.

Now provided that this geometrical principle applies to a flexible cylindrical vessel of this invention, a cylindrical vessel having an inclined open mouth corresponding to the above ellipse b will be able to be transformed into a circle corresponding to the circle c to accommodate with ease a drink container which should fit tightly into the vessel corresponding to the circle a because of flexibility or pliability of the vessel structure. Further, the finger groove line of this invention will be of help to transform the mouth-shape with hand manipulation by providing more pliability with the vessel.

Today chilled canned drinks are sold in large amounts and drinkers have gotten into the habit of drinking by fitting their mouths on cans, chiefly because chilled metal surface of a can gives glass-like touch effect. They will enjoy drinks more by using the vessel provided in this invention.

What is claimed:

1. A heat insulating vessel for holding a cylindrical drink container, said vessel tightly fitting around a portion of the cylindrical wall of the container, said vessel having a body integrally formed of a cylindrical wall portion and a bottom portion, the body being formed from a microcellularly foamed plastic, at least one horizontal finger groove means for receiving substantially the entire palm side of a user's finger, said finger groove means being formed in the wall portion and extending circumferentially completely around said wall portion, parallel to said bottom portion, wherein the upper edge of said cylindrical wall portion is inclined with respect to the bottom portion, said inclined upper edge having an elliptical shape and wherein when said finger groove means is depressed by the fingers of a user holding said vessel, said elliptical shape forms a circular shape having a diameter larger than the diameter of said bottom portion of said body thereby facilitating the placement of a container in said vessel, and wherein when said finger groove means is not depressed, the entire said inclined upper edge contacts the container inserted in said vessel.

2. A heat insulating vessel of claim 1 wherein the portion of the upper edge of the cylindrical wall is uniformly inclined with respect to the bottom portion.

3. A heat insulating vessel of claim 1 wherein the portion of the upper edge of the cylindrical wall forms an inclined curve with respect to said bottom portion.

4. A heat insulating vessel of claim 1 wherein the vessel is made of a microcellularly foamed core and non-foamed skin structure with a gross gravity of less than 0.1.

5. A heat insulating vessel of claim 4 wherein the microcellularly foamed core and non-foamed skin structure is molded by two-part soft polyurethane.

* * * * *